US006637469B2

(12) United States Patent
Hoffman et al.

(10) Patent No.: US 6,637,469 B2
(45) Date of Patent: Oct. 28, 2003

(54) PRODUCT DELIVERY SYSTEM FOR STATIONARY OR PORTABLE BULK CONTAINERS

(75) Inventors: Steven W. Hoffman, Reading, PA (US); Vladimir Yliy Gershtein, Allentown, PA (US); Alexandre De Almeida Botelho, Bethlehem, PA (US); Robert William Ford, Schnecksville, PA (US); Paul David Kottler, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/101,339

(22) Filed: Mar. 19, 2002

(65) Prior Publication Data

US 2003/0178091 A1 Sep. 25, 2003

(51) Int. Cl.[7] ..... B65D 88/00

(52) U.S. Cl. ..... 141/8; 141/5; 141/18; 141/86; 220/565; 220/560.11; 220/560.04; 220/1.5; 220/86.1; 280/830; 137/376; 137/592

(58) Field of Search ..... 141/4, 5, 7, 8, 141/18, 21, 86, 88, 98; 220/565–567, 567.1, 567.2, 567.3, 1.5, 86.1–86.4, 560.04, 560.09, 560.11, 581, 582, 584; 137/312, 376, 592; 280/830, 834, 836–839

(56) References Cited

U.S. PATENT DOCUMENTS

| | | | | | |
|---|---|---|---|---|---|
| 1,897,161 | A | * | 2/1933 | Endacott | 280/838 |
| 2,015,904 | A | * | 10/1935 | Marsh et al. | 220/581 |
| 2,354,438 | A | * | 7/1944 | Craig | 280/830 |
| 3,129,730 | A | * | 4/1964 | Simon | 141/286 |
| 4,685,327 | A | | 8/1987 | Sharp | 73/49.2 |
| 4,958,957 | A | | 9/1990 | Berg et al. | 405/55 |
| 4,986,436 | A | * | 1/1991 | Bambacigno et al. | 220/86.1 |
| 5,016,689 | A | | 5/1991 | McGarvey et al. | 141/198 |
| 5,071,166 | A | | 12/1991 | Marino | 280/230 |
| 5,673,562 | A | | 10/1997 | Friedt | 62/48.1 |
| 6,032,483 | A | | 3/2000 | Paganessi et al. | 62/620 |
| 6,089,027 | A | | 7/2000 | Wang et al. | 62/46.1 |
| 6,101,816 | A | | 8/2000 | Wang et al. | 62/48.1 |
| 6,122,931 | A | | 9/2000 | Paganessi et al. | 62/620 |

FOREIGN PATENT DOCUMENTS

| | | | |
|---|---|---|---|
| EP | 0624752 | 1/1996 | F17C/1/00 |
| EP | 0969242 | 1/2000 | F17C/1/00 |
| EP | 0969243 | 1/2000 | F17C/1/00 |
| WO | 98/57096 | 12/1998 | F17C/13/06 |

OTHER PUBLICATIONS

Chlorine Institute Emergency Kit "C", Chlorine Institute catalog "Chlorine Safety and Hazmat Emergency Equipment", section "C–Kit Design Features". Can also be found on the web site http://www.chlorinesafety.com/clequip.htm.

* cited by examiner

*Primary Examiner*—J. Casimer Jacyna
(74) *Attorney, Agent, or Firm*—John M. Fernbacher

(57) ABSTRACT

A container for holding a solid, liquid and/or gaseous phase product therein and for use within a transportable or stationary support structure. The container maximizes the compressed product volume contained therein and prevents liquid and/or contaminant entrainment during gaseous product delivery from liquid phase product. The system allows for product withdraw when the level is above the delivery valves using, at a minimum, two delivery legs linked by a compartment or housing that connects the delivery point and a container head space via a removable manway.

29 Claims, 9 Drawing Sheets

FIG.1A
PRIOR ART
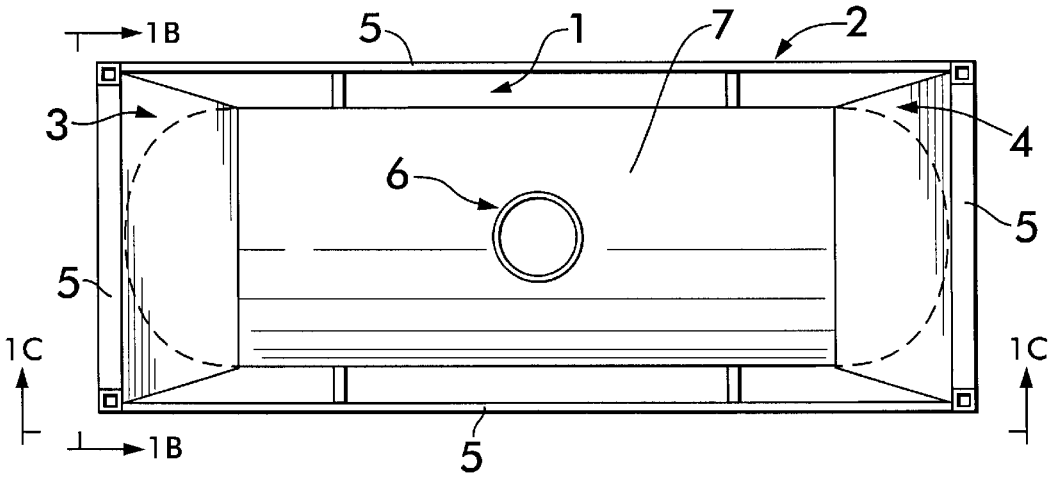
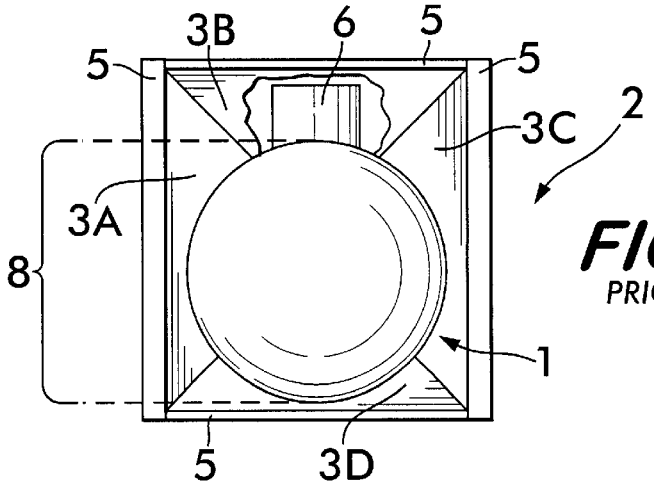
FIG.1B
PRIOR ART
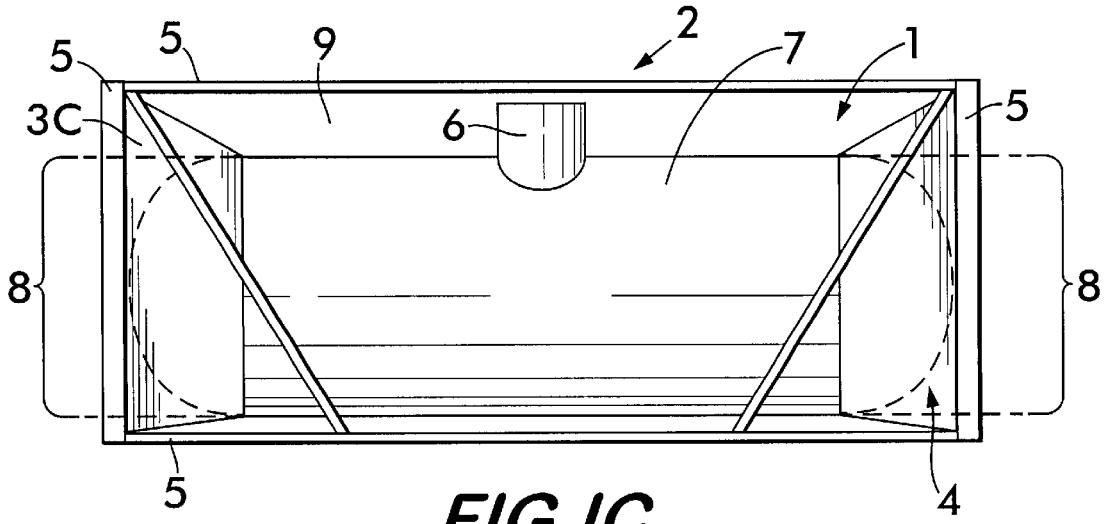
FIG.1C
PRIOR ART FIG.2A
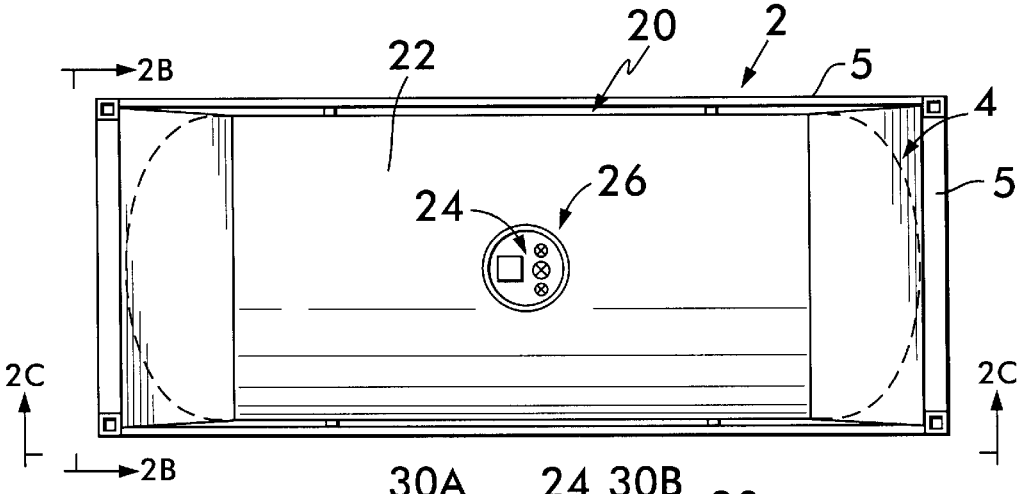
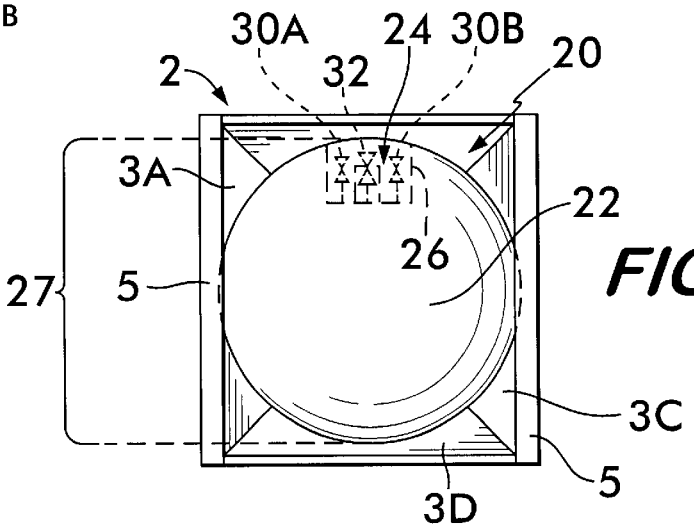
FIG.2B
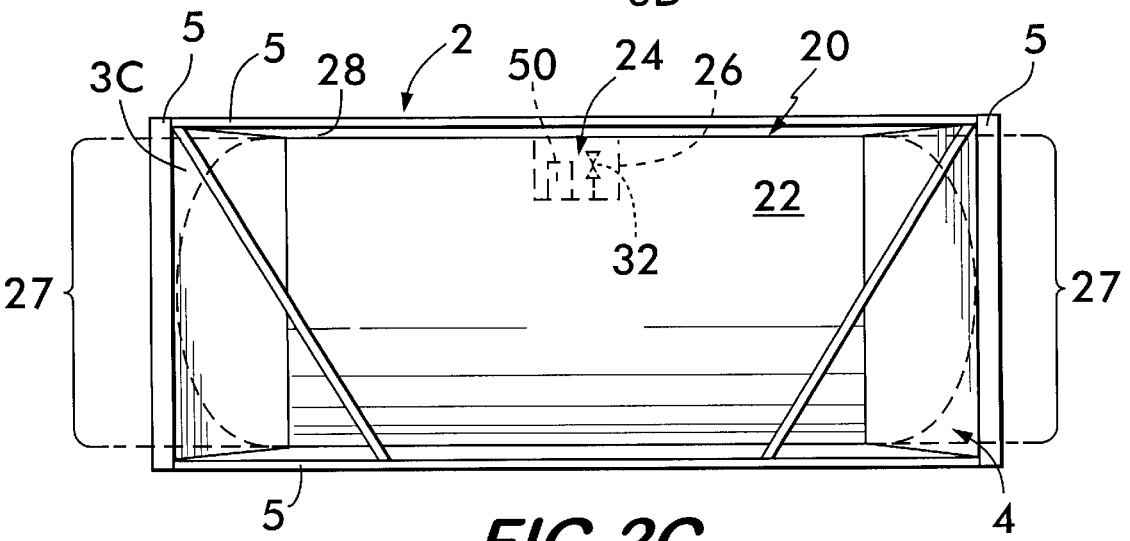
FIG.2C FIG.3A
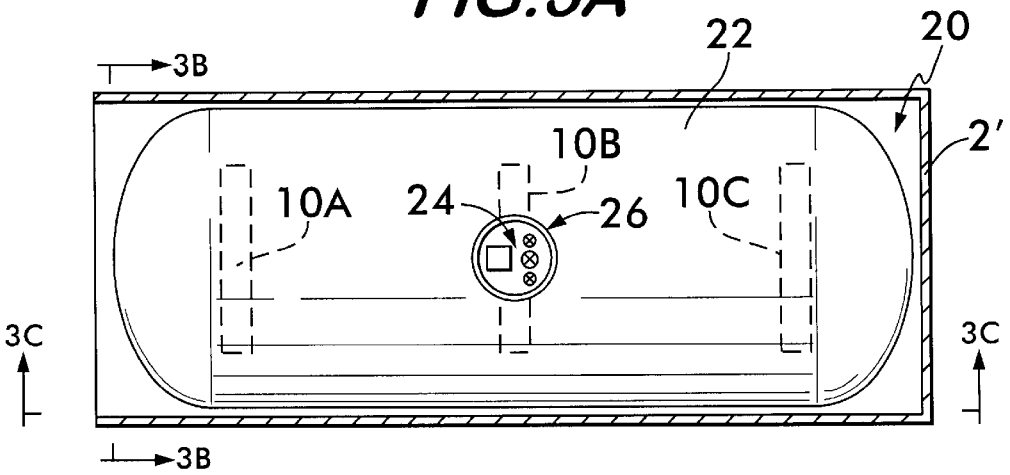
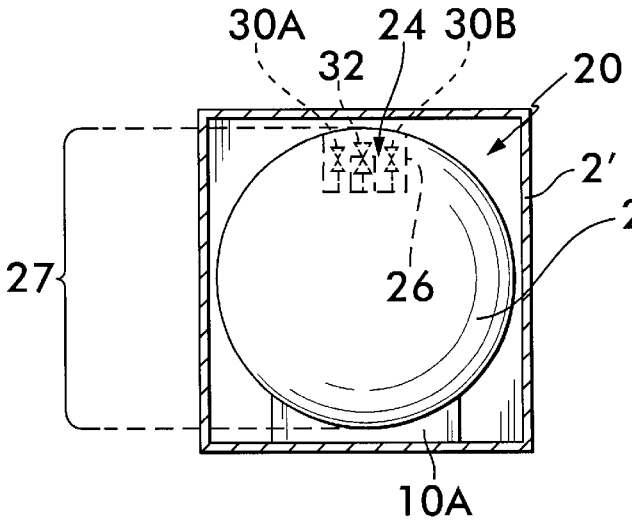
FIG.3B
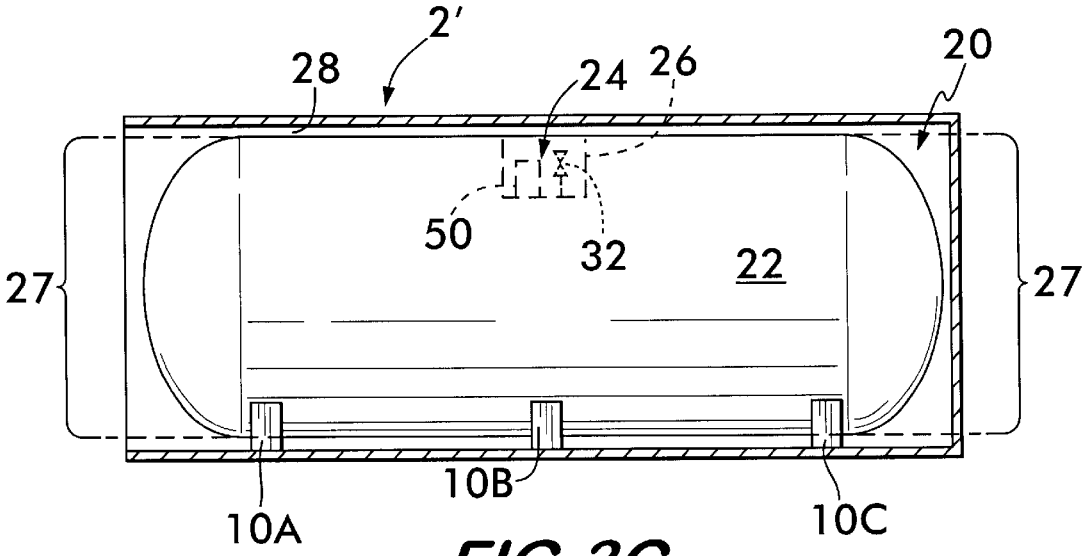
FIG.3C FIG.4
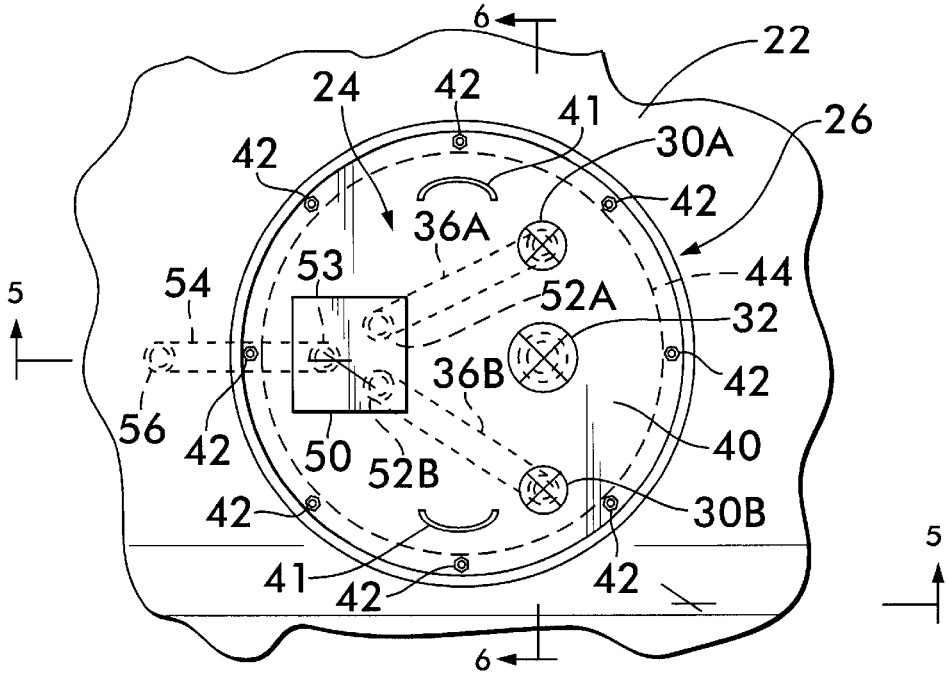
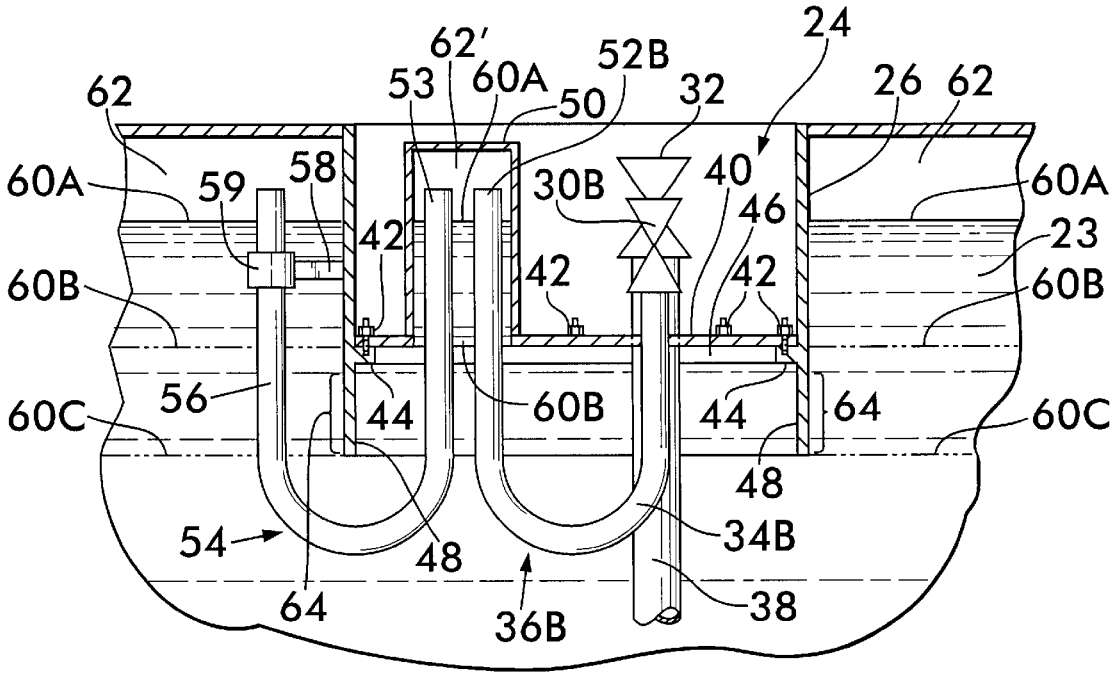
FIG.5

FIG. 7A
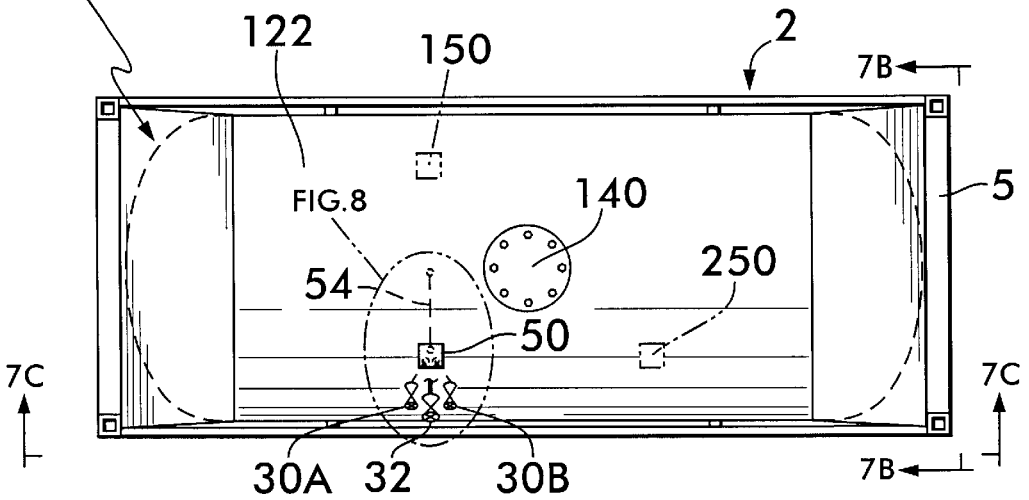
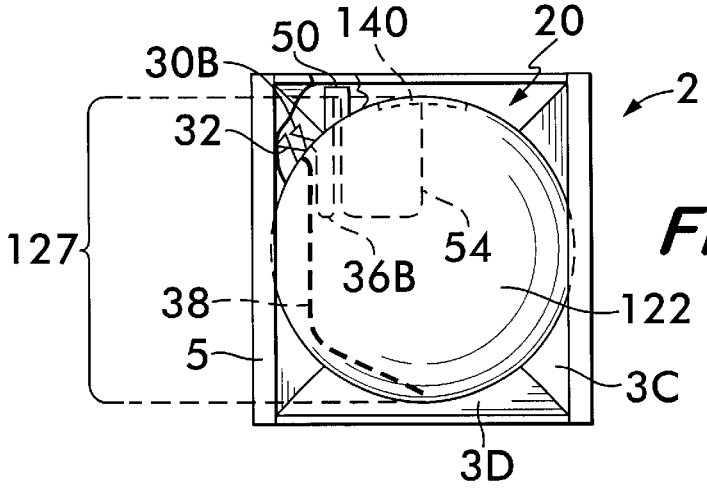
FIG. 7B
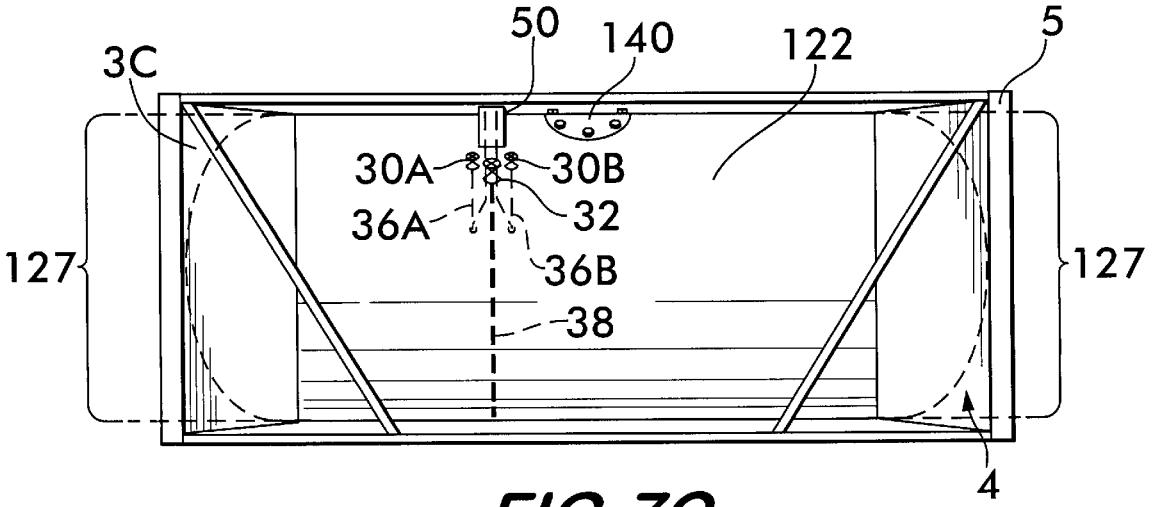
FIG. 7C

FIG.10A
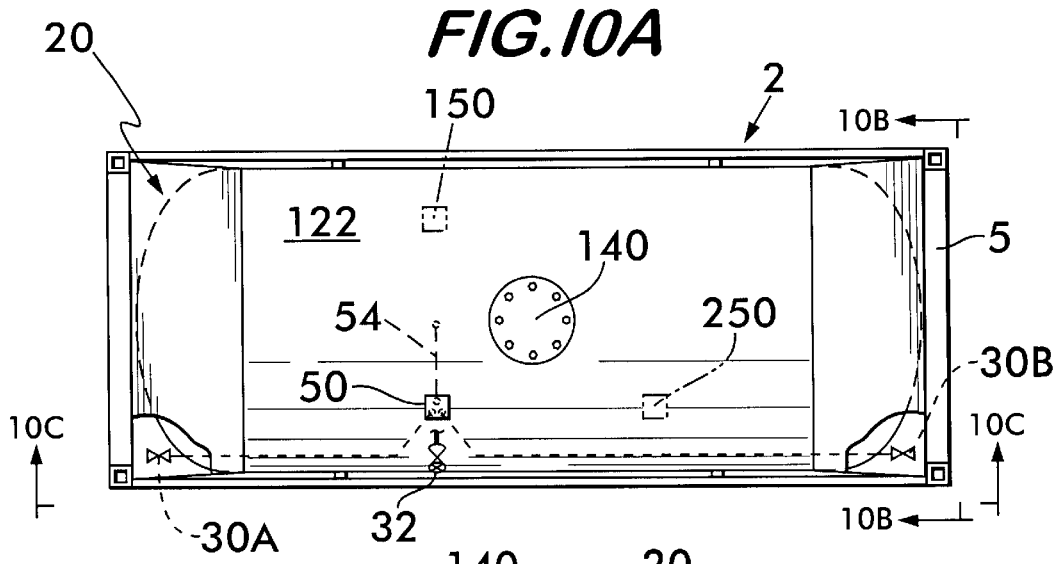
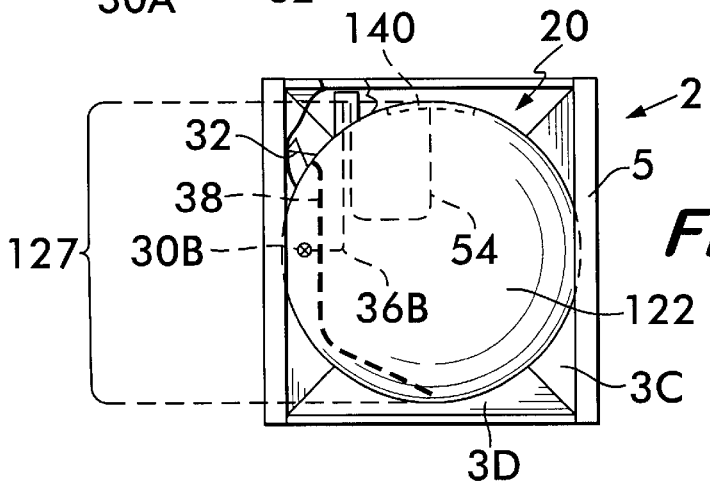
FIG.10B
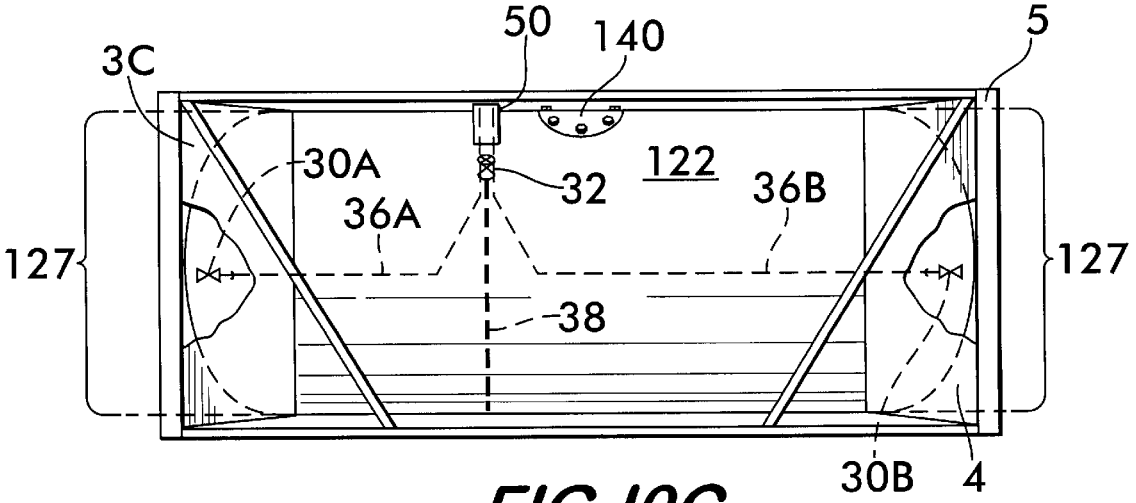
FIG.10C

PRODUCT DELIVERY SYSTEM FOR STATIONARY OR PORTABLE BULK CONTAINERS

BACKGROUND OF THE INVENTION

This invention is directed toward the delivery of pure, high purity (HP) and/or ultra high purity (UHP) product (solid, liquid, and or gaseous phase substance) from an internationally transportable or stationary bulk container to an end user.

Currently there is a need for a system that would allow for the maximization of deliverable product quantity as harbored by a container whose construction is governed by transportation local requirements. The system and container must be suitable for international transportation, meeting the requirements of the International Organization for Standardization (ISO) and/or the authority having jurisdiction in the transportation local. Additionally, stationary and/or portable domestic containers and delivery systems must meet the requirements of the U.S. Department of Transportation (DOT) regulations (e.g., 49 C.F.R. §173.315 and 49 C.F.R. §178.245). The pertinent requirements based on these standards require that the container design and fabrication include a support structure (e.g., a frame, etc.) that provides a secure base for transport, that process or service equipment must be arranged so that the equipment is protected from damage and that provisions for man access to the internal volume of the container must be provided.

The use of portable bulk product containers or shells positioned in support structures for stationary support or for transportation by truck, railcar and/or ship is well-known. As shown by way of example in FIGS. 1A∝1C, a prior art container 1 is positioned inside a support structure 2 of predetermined dimensions. In most cases, the container is fixedly-secured within the support structure 2, although there are situations where the container may be releasably-secured within the support structure 2. In particular, the container 1 is fixedly secured (e.g., welded) to the support structure 2 via end skirts 3 and 4. As can be seen most clearly in FIG. 1B, each end skirt (only one of which, 3, is shown in FIG. 1B, it being understood that end skirt 4 is similarly constructed) may comprise four surfaces 3A–3D having edges that are fixedly secured (e.g., welded) to struts 5 at the ends of the support structure 2. These end skirts are by way of example only and it should be understood that there are many other ways known in the art of securing the container 1 within the support structure 2.

Furthermore, although not shown, process or service equipment (e.g., valves, pressure regulators, filters, etc.) and corresponding peripherals, referred to as "appurtenances" (e.g., covers, manways, safety chains, pressure gauges, etc.) are located on the outside surface of the container 1 and protrude or jutt out from the periphery of the container 1; hereinafter, the combination of process (or service) equipment and appurtenances are referred to as "equipment". For example, as shown in FIGS. 1A–1C, a boss 6 represents an exemplary location of the equipment on the outside surface 7 of the container 1 and illustrates how such equipment generally protrudes from the periphery 8 of a container 1.

Exemplary dimensions of a support structure 2 containing a container 1 may comprise 20 ft×8 ft×8 ft/6 in. (e.g., ISO standard). The important aspect is that the support structure 2 establishes a fixed volume into which the container 1, and all of its associated equipment, must be positioned. Therefore, the size of the container 1 must be reduced to allow for inclusion of the equipment; this in turn reduces the quantity of product that can be carried by the container 1. As a result, there is wasted volume 9 in the support structure 2 but yet contained within the support structure 2 volume.

The following U.S. patents are exemplary patents related to the delivery of gaseous or liquid phase product from a container: U.S. Pat. No. 5,673,562 (Friedt); U.S. Pat. No. 6,032,483 (Paganessi, et al.); U.S. Pat. No. 6,089,027 (Wang, et al.); U.S. Pat. No. 6,101,816 (Wang, et al.); and U.S. Pat. No. 6,122,931 (Paganessi, et al.).

U.S. Pat. No. 6,032,483 (Jurcik, et al.) discloses a system that is an on-site non-transportable system which utilizes one or a series of like or different distillation, absorption or adsorption columns and which processes a chemical where a heavy liquid is separated from the lighter vapor which is then delivered to the point of use. This non-transportable system uses pumps, heaters, columns, etc. to obtain and deliver the desired product.

U.S. Pat. No. 6,122,931 (Jurcik, et al.) discloses a system for vapor delivery which includes a separation column or columns that accepts liquid delivered from a storage vessel containing a chemical stored under its own vapor pressure and separates out the vapor phase from liquid phase in a process utilizing the phase weight variance. The final vapor phase is provided to the point of delivery. This system utilizes external or internal columns to provide vapor and is also not transportable.

U.S. Pat. No. 6,089,027 (Tom, et al.) discloses a fluid storage and dispensing system. The vessel used in that system has a volume of no greater than approximately 50 liters in its maximum aspect application and delivers fluid utilizing a fluid dispensing system but does not disclose the delivery of gaseous or solid phases.

U.S. Pat. No. 6,101,816 (Tom, et al.) discloses a fluid dispensing system that utilizes a pressure regulator and a pulse separator or membrane for the separation of gas vapor and liquid product. This invention delivers only vapor phase product and utilizes external controls for the regulation of product conditions.

U.S. Pat. No. 5,071,166 (Marino) discloses a transportable liquid holding tank that includes an inner tank and an outwardly-spaced rigid enclosure whereby a compartment is formed between these two items that supports an access assembly.

EP 0 969 242 A2 and EP 0 969243 A2 disclose torroidal containers that utilize head pieces for multiple valve groups.

The following patents give examples of containers that utilize inner and outer containers and/or are stored underground and utilize mechanisms to minimize leaks from these containers: U.S. Pat. No. 4,685,327 (Sharp); U.S. Pat. No. 4,958,957 (Berg et al.); and U.S. Pat. No. 5,016,689 (McGarvey); and EP 0 624 752 B1 (Poillucci).

After an examination of the previously-cited prior art, it is apparent that there remains a need for a container that maximizes the amount of product-containing volume and that can be used with a support structure while complying with U.S. DOT regulations, as well as international transportation regulations. Additionally, there remains a need for such a container to be equipped with a system that facilitates the delivery of product to an end user at various levels of product entropy.

BRIEF SUMMARY OF THE INVENTION

A An embodiment of the invention includes a container comprising an interior having a first head space located above a product (e.g., a solid, liquid and/or gaseous phase product) contained therein, wherein the product comprises a filled level and wherein the container comprises a head space valve having a bottom that is located below the filled level. The container further comprises:

a housing coupled to said container and having a housing interior that is exposed to the product in said container, said housing comprising a second head space above the product;

a primary transport line having a first open end positioned in said first head space and a second open end positioned in said second head space: and a secondary transport line having a third end coupled to said head space valve and a fourth open end disposed in said second head space.

Another embodiment of the invention includes a container that is secured entirely within a support structure (e.g., a frame in accordance with U.S. Department of Transportation regulations and/or international transportation regulations such as the International Organization for Standardization) having a fixed volume. The container comprises: a product therein (e.g., a solid, liquid and/or gaseous phase product); an outer surface having a periphery; equipment (e.g., process/service equipment including valves, pressure regulators, filters, etc., and appurtenances including covers, manways, safety chains, pressure gauges, etc.), coupled to the outer surface, that provides communication to the product in the container; wherein the outer surface further comprises a recess for locating the equipment therein, and wherein the recess prevents the equipment from protruding beyond the periphery of the outer surface. The container further comprises a first head space located above the product wherein said equipment comprises a head space valve.

A further embodiment of the invention includes a method for maximizing the amount of product (e.g., a solid, liquid and/or gaseous phase product) in a container whose interior comprises a first head space located above a product contained therein, wherein the product comprises a filled level and wherein the method comprises the steps of placing a first valve in communication with the first head space; locating a bottom of the first valve below the filled level: providing a housing coupled to said container and wherein said housing has a second interior that is exposed to the product in said container; providing a first open end of a primary transport line in said upper portion of said first interior of said container and positioning a second open end of said primary transport line in said second interior of said housing; and coupling a third end of a secondary transport line to said first valve and positioning a fourth open end of said secondary transport line in said second interior of said housing.

A further embodiment of the invention includes a method for maximizing the amount of product (e.g., a solid, liquid and/or gaseous phase product) in a container that is secured entirely within a support structure (e.g., a frame in accordance with U.S. Department of Transportation regulations and/or international transportation regulations such as the International Organization for Standardization) of a fixed volume. The method comprises the steps of providing a container whose outer surface defines a periphery and wherein the container comprises a product therein; providing a recess in the outer surface; and positioning equipment (e.g., process/service equipment including valves, pressure regulators, filters, etc., and appurtenances including covers, manways, safety chains, pressure gauges, etc.) within the recess such that the recess prevents the equipment from protruding beyond the periphery of the outer surface and wherein the equipment provides communication to the product in the container. The method also comprises providing a base for said recess; providing a housing coupled to said base and wherein said housing has a second interior that is exposed to the groduct in said container; positioning a first open end of a primary transport line in said upper portion of said first interior of said container and positioning a second open end of said primary transport line in said second interior of said housing; and coupling a third end of a secondary transport line to said first valve and positioning a fourth open end of said secondary transport line in said second interior of said housing.

BRIEF DESCRIPTION OF SEVERAL VIEWS OF THE DRAWINGS

The invention will be described by way of example with reference to the accompanying drawings, in which:

FIG. 1A is a top view of an exemplary prior art container secured within a support structure showing the use of end skirts with the prior art container ends shown in phantom;

FIG. 1B is a partially broken-away end view of the prior art container and support structure taken along line 1B—1B of FIG. 1A;

FIG. 1C a side view of the prior art container and support structure taken along line 1C—1C of FIG. 1A;

FIG. 2A is a top view of the present invention container secured within a support structure showing the use of end skirts with the present invention container ends shown in phantom;

FIG. 2B is a end view of the present invention container and support structure taken along line 2B—2B of FIG. 2A showing the recess and equipment therein in phantom;

FIG. 2C a side view of the present invention container and support structure taken along line 2C—2C of FIG. 2A;

FIG. 3A is a top view of the present invention container secured within another support structure, or generally confined area, showing the use of container skids in phantom;

FIG. 3B is a end view of the present invention container and support structure taken along line 3B—3B of FIG. 3A showing the recess and example equipment therein in phantom;

FIG. 3C a side view of the present invention container and support structure taken along line 3C—3C of FIG. 3A;

FIG. 4 is top plan view of the internals of the recess in the container of the present invention;

FIG. 5 is a side, cross-sectional view of the recess in the container taken along line 5—5 of FIG. 4;

FIG. 7A is a top view of another embodiment of a container of the present invention secured within a support structure showing the use of end skirts with the container ends shown in phantom;

FIG. 7B is an end view of the present invention container of FIG. 7A taken along line 7B—7B of FIG. 7A;

FIG. 7C is a side view of the present invention container of FIG. 7A taken along line 7C—7C of FIG. 7A;

FIG. 10A is a top view of a third embodiment of a container of the present invention secured within a support structure showing the use of end skirts with the container ends shown in phantom;

FIG. 10B is an end view of the present invention container of FIG. 10A taken along line 10B—10B of FIG. 10A; and FIG. 10C is a side view of the present invention container of FIG. 10A taken along line 10C—10C of FIG. 10A.

DETAILED DESCRIPTION OF THE INVENTION

Figure 6:
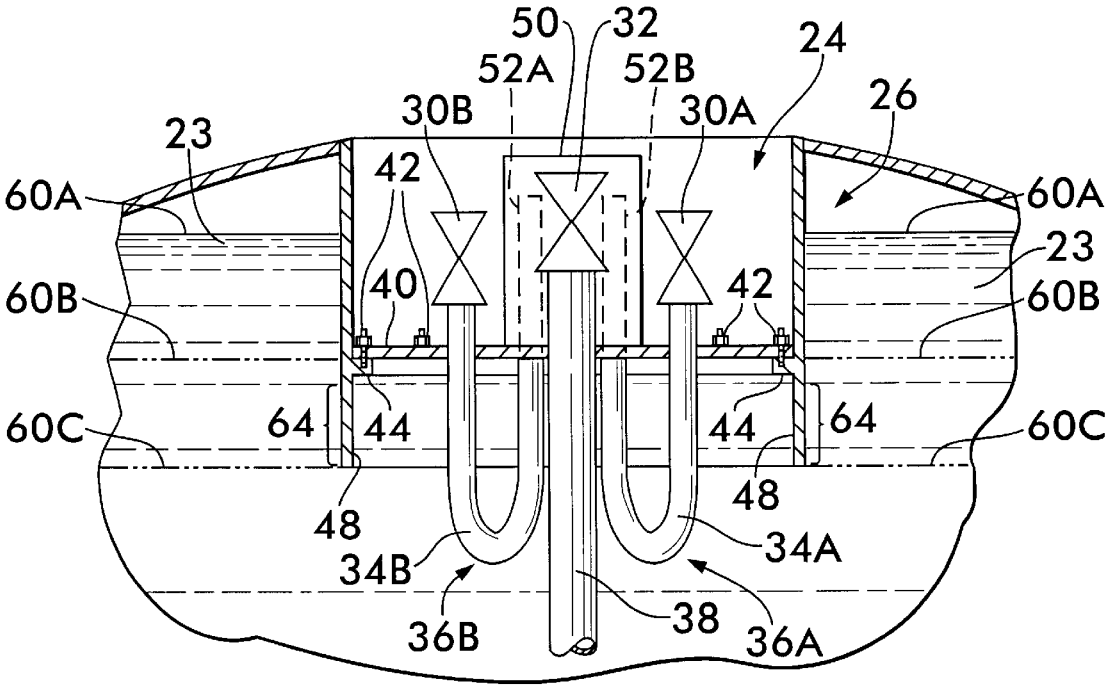
FIG. 6 is a back, cross-sectional view of the recess in the container taken along line 6—6 of FIG. 4.
Figure 8:
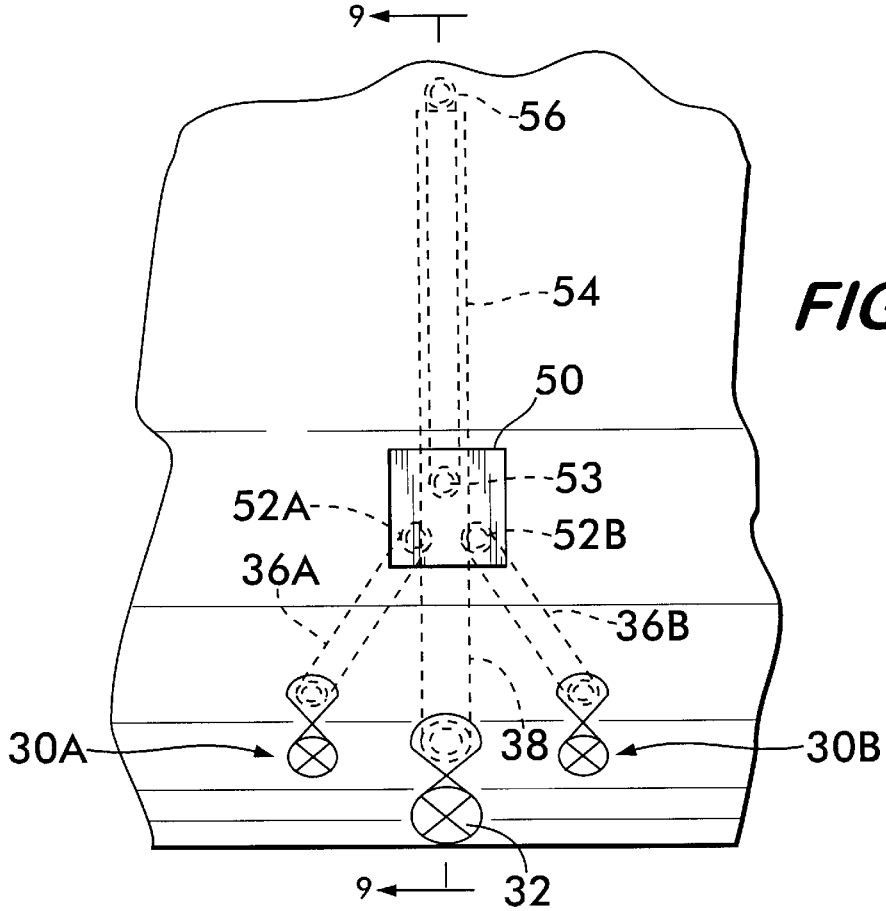
FIG. 8 is an enlarged view of the valves and transport lines, shown in phantom, that are shown in FIG. 7A.

The invention 20 maximizes the product volume of a portable or stationary container by having the capability of product recovery when the product level is above the delivery valve(s). The invention 20 provides for a portable or stationary bulk product container designed for vacuum and/or atmospheric and positive pressures, and having an integral product delivery system that supports a range of flow rates and is sized for the application. It should be understood that the term "product" used hereinafter includes solid, liquid and/or gaseous phase product. Exemplary solids may include but are not limited to the following: powder (e.g., graphite, etc.); particulate; slurry (e.g., mixture of two substances one liquid and one solid). Exemplary liquids may include but are not limited to the following: milk, water, ink, paint, any compressed liquefied gas (e.g., ammonia; butadiene, inhibited; carbon dioxide, refrigerated liquid; chlorine; ethane, refrigerated liquid; ethane-propane mixture, refrigerated liquid; hexafluoropropylene; hydrogen chloride, refrigerated liquid; liquefied petroleum gas; methyl chloride; methyl mercaptan; nitrous oxide, refrigerated liquid; sulfur dioxide; vinyl methyl ether; etc.). Exemplary gaseous phases may include but are not limited to the following: the vapor phase of the above listed liquid phase products (e.g., ammonia, chlorine, nitrogen etc.).

In particular, as shown in FIGS. 2A–2C, the invention 20 comprises a container 22 that occupies a large portion of the fixed volume of a support structure 2 (discussed earlier) and exemplary equipment 24 (e.g., process or service equipment and appurtenances, also discussed earlier) that is positioned within a recess 26 within the outer surface of the container 22. As can be seen from FIGS. 2A–2C, the equipment 24 does not project beyond the periphery 27 of the outer surface of the container 22. As a result, the size of the container 22 fills a greater portion of the support structure 2 volume and greatly minimizes any unused volume 28 (FIG. 3C) within the support structure 2. An additional benefit of locating any process/service equipment and/or appurtenances inside the recess 26 is a significant decrease in the risk of damage and hence increased safety.

FIG. 4 provides a top plan view of the recess 26 of the container 22. In general, the equipment 24 in the recess 26 comprises at least one valve for providing communication to the interior of the container 22. In particular, as mentioned earlier, the product carried within the container 22 may comprise a solid, liquid and/or gaseous phase product. FIGS. 5–6 comprise a cross-sectional view of an upper portion of the container 22 and recess 26; these views depict a solid or liquid phase product forming the contents 23 of the container 22 and having an upper level indicated by the reference number 60A, it being understood that a gaseous phase product would occupy the entire volume of the container 22 and thus would not exhibit an "upper level 60A." Product is introduced to, and removed from, the container 22 using a product valve 32 and corresponding product tube 38, although, as will be discussed later, head space valves can also be used, with or without corresponding product tube.

As shown by way of example only in FIG. 4, the recess 26 contains a first valve 30A, a second valve 30B and the product valve 32. The valves 30A–30B (also referred to as "head space valves") are coupled to respective legs 34A and 34B (see FIG. 6) of secondary transport lines 36A and 36B, as will be discussed in detail later; the product valve 32 is coupled to the product tube 38 which includes an open end (not shown) that reaches to the bottom of, or closely-adjacent the bottom of, the container 22. It should be understood that the number of valves, as well as the number of secondary transport lines, are by way of example only.

The bottom or base of the recess 26 comprises a manway 40 that is releasably secured to the container 22 via releasable securement means 42 (e.g., nuts and bolts). The manway 40 rests on an annular shoulder 44 of an opening 46 (FIGS. 5 and 6) in the container 22. The manway 40 can be removed, thereby providing direct access by authorized personnel to the inside of the container 22 for inspection, maintenance, and other procedures requiring direct access; lugs 41 may be provided for grasping the manway 40. The legs 34A and 34B of the secondary transport lines 36A and 36B, as well as the tube 38, are fixedly or releasably secured (e.g., welded, brazed, etc.) to the manway 40; thus, when the manway 40 is removed, the valves 30A–30B and 32, along with the secondary transport lines 36A and 36B and tube 38, are removed with the manway 40. This feature of having the secondary transport lines 36A/36B and the tube 38 removed along with the manway 40 is desirable because it provides for the opening 46 to be unobstructed when authorized personnel must conduct inspection, maintenance, and other procedures requiring direct access to the container 22 interior. In addition, a circumferential brim 48 (FIG. 5) protrudes downward into the container 22, the importance of which will be discussed later.

Also releasably or fixedly-secured to the manway 40 is a housing 50 sized and shaped to meet product flow requirements that encloses the respective open-ended legs 52A/52B of the secondary transport lines 36A and 36B, as well as one open-ended leg 53 of a primary transport line 54 when the manway 40 is installed; when the manway 40 is removed, the leg 53 of the primary transport line 54 is exposed to the environment. The other open-ended leg 56 of the primary transport line 54 is secured to the inside of the container 22; for example, using an arm 58 and fitting 59. As with the equipment 24, the housing 50 also does not protrude beyond the periphery 27 of the container 22.

Depending on the type of product within the container 22, the head space valves 30A–30B, primary/secondary transport lines 54 and 36A/36B and product valve/tube 32 and 38 can be used in combination to effect the removal of the product when the container 22 is at the delivery point.

FIG. 5 indicates three exemplary liquid levels, 60A, 60B and 60C that are referred to in the following functional example, given the existence of liquid and gaseous (vapor) phase product in the container 22. When the liquid level is at height 60A, as mentioned earlier, there is complete vapor withdraw through one or both of the secondary transport legs 36A/36B, i.e., vapor is drawn directly from the first head space 62 of the container 22, through the primary transport line 54, into the housing 50 and then through the secondary transport lines 36A and/or 36B and through the respective valves 30A/30B. As the liquid level drops to between levels 60B and 60C, the functionality of the circumferential brim 48 is realized in preventing liquid entrainment. "Entrainment" as used in this example is defined as liquid phase product or product contaminants gaining access into the primary or secondary transport lines; entrainment covers any type of liquid phase product entry into the transport lines, including droplets of liquid phase product. In particular, the circumferential brim 48 creates a liquid head that is significantly large as compared to that in the secondary transport lines 36A and 36B (approximately zero) and prevents the entrainment of liquid directly through the housing 50. When the liquid height drops below level 60C, vapor is directly drawn through the housing 50 into the secondary transport lines 36A and 36B where liquid entrainment through the secondary transport lines 36A/36B is no longer a concern. In other words, if the circumferential brim 48 were not present, once the liquid reached level 60B, the open ends of the legs 53 and 52A/52B of the primary/secondary transport lines 54 and 36A/36B would be exposed to the liquid level 60B of the entire container 22. In contrast, with the circumferential brim 48 in place, the open ends of legs 53 and 52A/52B are only exposed to the liquid level contained by the circumferential brim 48. Thus, the length 64 of the brim 48 represents a threshold distance at which the liquid level of the entire container 22 no longer presents an entrainment concern to the open ends of legs 53 and 52A/52B of the respective transport lines.

Other examples of the use of the invention 20 for delivering liquid and solid phases of product are as follows:

The invention 20 as described in the previous paragraphs can also deliver liquid phase product through the application of positive pressure to head space valves 30A and/or 30B, e.g., by coupling a pump, not shown, to one or both of the valves 30A/30B. As pressure builds in the top of the container 22, liquid product is forced out through the product tube 38. Alternatively, pulling a vacuum on product valve 32 serves to recover liquid phase product, e.g., by coupling a vacuum source, not shown, to the product valve 32 to force liquid phase product up through the tube 38 and out of the valve 32.

Figure 9:
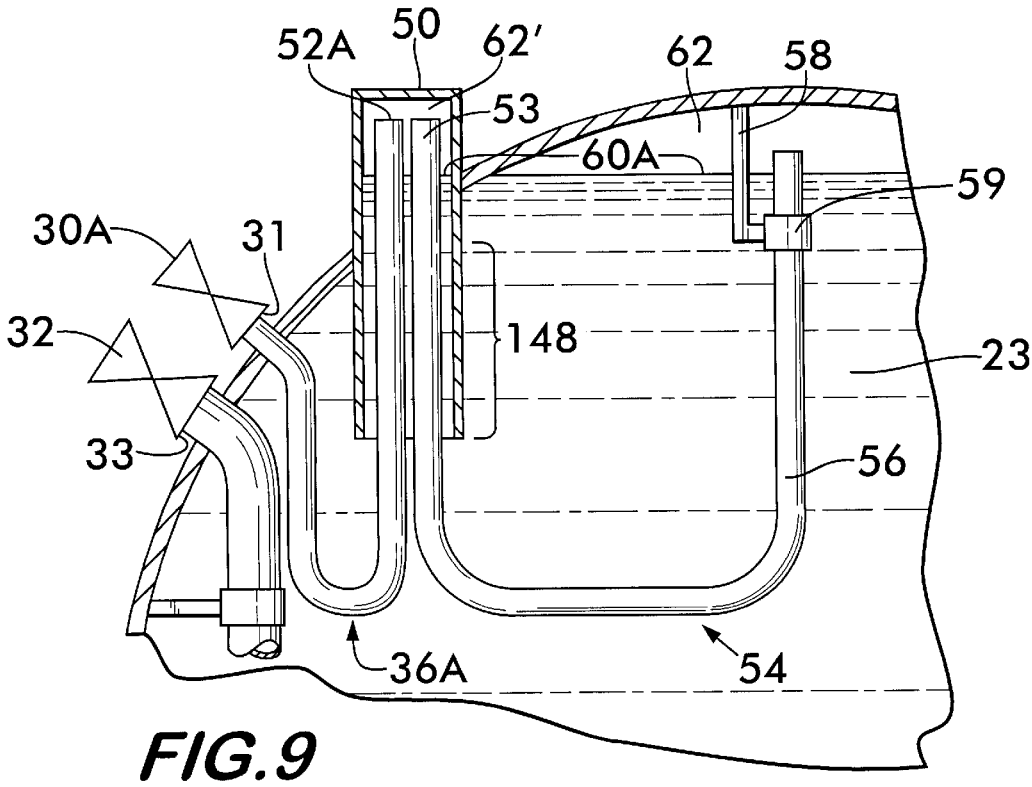
FIG. 9 is a cross-sectional view of the enlarged area of FIG. 8 taken along line 9—9 of FIG. 8.
Figure 9A:
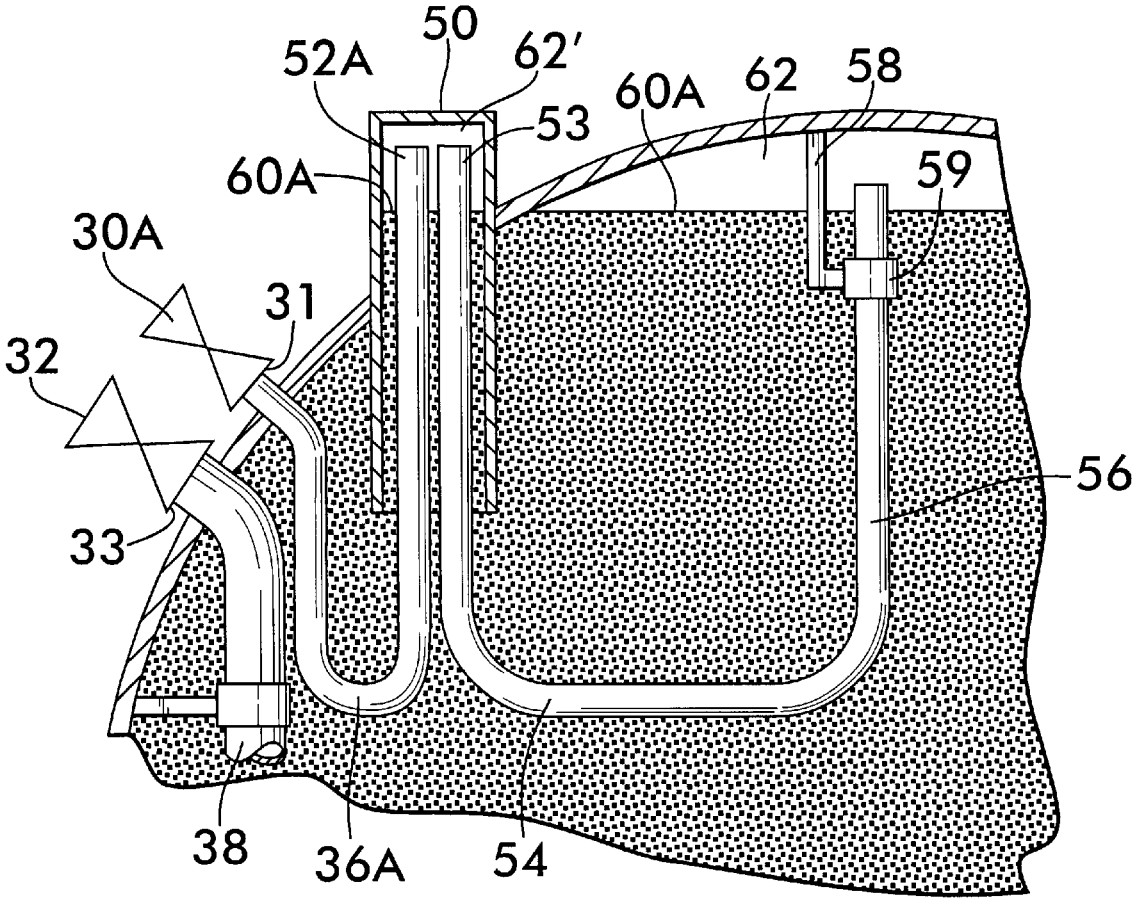
FIG. 9A is a similar cross-sectional view of the enlarged area of FIG. 8 taken along line 9—9 of FIG. 8 but showing a solid phase product (e.g., particulate or granular)

The invention 20 can also deliver solid phase product (e.g., particulate or granular), such as shown in FIG. 9A, by applying positive pressure through the product valve 32/product tube 38 with a gas that agitates such a solid. Then, by pulling a vacuum through, or creating a pressure differential across, head space valves 30A and/or 30B, the solid phase product passes through the primary transport line 54 and through one or both of the secondary transport lines 36A/36B, as discussed previously with respect to vapor removal using those lines. Furthermore, if the solid is particulate, granular or gel-like it could also be withdrawn through the product tube 38 and product valve 32 utilizing a vacuum.

The invention 20 can also deliver gaseous phase product by simply opening/closing the head space valves 30A/30B, with the passage of the gaseous phase product through the transport lines 54 and 36A/36B in accordance with the vapor removal discussed previously. Additionally, opening/closing of the product valve 32 can also be used to remove the gaseous phase product.

FIGS. 3A–3C show the container 22 of the present invention 20 used in a closed support structure 2¢. A plurality of container skids 10A–10C may be used to stabilize the container 22 therein. The construction of the container 22 and the equipment 24 of the present invention 20 is similar to that described earlier in FIGS. 2A–2C and 4–6 and is not repeated here. It should be appreciated that the closed support structure 2¢ of FIGS. 3A–3C can also represent any generally confined area, i.e., an environment into which the container 22 can be positioned and wherein the equipment 24 does not protrude out of this generally confined area 2¢. Thus, for example, with the container 22 itself of the present invention 20 positioned in any space having a volume corresponding to the closed support structure 2¢, the container 22 maximizes the quantity of product contained within this volume while avoiding any clearance problems by the use of the recessed equipment 24.

FIGS. 7A–10C depict other variations of the container 22 wherein product (e.g., solid, liquid or gaseous phase) withdraw can be achieved using the primary transport line 54 and the secondary transport line 36A or 36B when the product level is above the head space valves 30A or 30B, with or without the use of the recess 26. As with the container 22, it should be understood that the number of head space valves, as well as the number of secondary transport lines, are by way of example only.

In particular, FIGS. 7A–10C, the head space valves 30A/30B are positioned on the outside surface of the container 122 (which does not include any recess 26) at a location different from a conventional manway 140; thus, the head space valves 30A/30B, the housing 50, as well as the product valve 32, jut out of the periphery 127 of the container 122 but not out of the support structure 2. As shown most clearly in FIG. 9, the important aspect of container 122 is that the bottom 31 of the head space valve 30A or 30B is beneath the filled level 60A of the product 23. In fact, the head space valve 30A or 30B can be located at any location around the container 122. This can also be seen by FIGS. 10A–10C where the head space valves 30A and 30B are located at the ends of the container 122 (see FIG. 10A). The housing 50 itself can be located remotely from the head space valves 30A/30B and alternative locations are shown by the square symbols 150 and 250 in FIGS. 7A and 10A. Although not required, the bottom 33 of the product valve 32 can also be located beneath the filled level 60A of the product 23. Because of the location of the product valve 32, the tube 38 is bent, as shown most clearly in FIG. 7B.

It should be noted that where the housing 50 is remotely-located from the manway 140, as shown in FIGS. 7A–10C, the brim 48, as discussed in relation to the container 22, is incorporated into the elongated housing as indicated by reference number 148 (FIG. 9). Thus, this elongated housing 148 operates similarly to the brim 48 in that it represents a threshold distance at which the liquid level of the entire container 122 no longer presents an entrainment concern to the open ends 53 and 52A/52B of the respective transport lines.

In view of the container 122, it can be seen that the container 22 is a special case of container 122, i.e., use of the recess 26, by definition, places the bottom 31 of the head space valves 30A/30B below the filled level 60A of the product 23 (as can be seen most clearly in FIG. 6). However, positioning the bottom of the head space valves 30A/30B does not require the use of the recess 26 and those valves 30A/30B can be located in an infinite number of positions around the container 122 whereby the bottom 31 of the valves 30A/30B are located beneath the filled level 60A.

Materials chosen for construction of the containers 22/122 are, for example, standard pressure vessel construction materials, low carbon steels and readily available stainless steels that are inherently inert to the product being used and are suitable for expected environmental and process conditions. In addition, these materials are readily available, formable, weldable, cost effective and proven. Additionally, aluminum, plastics or composite materials could be used to construct such a vessel. In some instances, it is desirable to condition, coat, or line the interior container surface as required for product purity.

The usefulness of the present invention 20 is that it provides for a means for the delivery of product from a bulk supply portable or stationary container that maximizes the quantity of transportable product and incorporates and protects a removable manway and equipment (both process equipment and appurtenances). This invention 20 may be used for standard, high purity and/or ultra high purity product that proves useful for requirements spanning various grades of solids, liquids and/or gaseous phase products. It should be also noted that because the equipment 24 and manway 40 are located within the recess 26, should the container 22 ever become unstable (e.g., during container transport, loading or unloading, etc.) and sustain an impact, the equipment 24 and manway 40 are protected from rolling or shearing damage, thereby adding safety to the design.

What is claimed is:

1. A container comprising an interior having a first head space located above a product contained therein, wherein the product comprises a filled level, said container comprising a head space valve having a bottom that is located below said filled level, and wherein the container further comprises:

a housing coupled to said container and having a housing interior that is exposed to the product in said container, said housing comprising a second head space above the product;

a primary transport line having a first open end positioned in said first head space and a second open end positioned in said second head space; and a secondary transport line having a third end coupled to said head space valve and a fourth open end disposed in said second head space.

2. The container of claim 1 wherein said product comprises a liquid phase and a vapor phase, said vapor phase occupying said first and second head spaces, said vapor phase being removable from said container through said primary and secondary transport lines and said head space valve.

3. The container of claim 2 wherein said housing comprises a brim that projects into said container.

4. The container of claim 1 wherein said product is a solid phase product, said solid phase product being removable from said container through said primary and secondary transport lines and said head space valve.

5. The container of claim 1 wherein said product is a gaseous phase product, said gaseous phase product being removable from said container through said primary and secondary transport lines and said head space valve.

6. The container of claims 1 being secured entirely within a support structure having a fixed volume.

7. The container of claim 6 further comprising an outer surface having a periphery, said outer surface comprising a recess for locating said head space valve and said housing therein, said recess preventing said head space valve and said housing from protruding beyond said periphery of said outer surface.

8. A container that is secured entirely within a support structure having a fixed volume, said container comprising:

a product therein;

an outer surface having a periphery;

equipment, coupled to the outer surface, that provides communication to the product in said container;

said outer surface further comprising a recess for locating said equipment therein, said recess preventing said equipment from protruding beyond said periphery of said outer surface;

wherein said container further comprises a first head space located above the product and wherein said equipment comprises a head space valve, wherein said recess further comprises:

a base;

a housing coupled to said base and having an interior that is exposed to the product in said container and that contains a second head space above the product;

a primary transport line having a first open end positioned in said first head space and a second open end positioned in said second head space; and a secondary transport line having a third end coupled to said head space valve and a fourth open end disposed in said second head space.

9. The container of claim 8 wherein said base comprises a manway that is releasably secured to an edge of an opening in said container, said housing and said secondary transport line being coupled to said manway such that when said manway is removed from said edge, said housing and said secondary transport line are also removed therewith.

10. The container of claim 9 wherein said equipment further comprises a product valve and wherein said container further comprises a product tube in communication with said product valve, said product tube being coupled to said manway and having an open end that is disposed in the product when said manway is secured to said edge, said product tube being removed with said manway when said manway is removed from said edge.

11. The container of claim 10 wherein said product comprises a liquid phase and a vapor phase, said vapor phase occupying said first and second head spaces, said vapor phase being removable from said container through said primary and secondary transport lines and said head space valve.

12. The container of claim 11 wherein said opening comprises a brim that projects into said container.

13. The container of claim 10 wherein said product is a solid phase product, said solid phase product being removable from said container through said primary and secondary transport lines and said head space valve.

14. The container of claim 10 wherein said product is a gaseous phase product, said gaseous phase product being removable from said container through said primary and secondary transport lines and said head space valve.

15. A method for maximizing the amount of product in a container whose interior comprises a first head space located above a product contained therein and wherein the product comprises a filled level, said method comprising the steps of:

placing a first valve in communication with said first head space;

locating a bottom of said head space valve below said filled level;

providing a housing coupled to said container and wherein said housing has a second interior that is exposed to the product in said container;

providing a first open end of a primary transport line in said upper portion of said first interior of said container and positioning a second open end of said primary transport line in said second interior of said housing; and coupling a third end of a secondary transport line to said first valve and positioning a fourth open end of said secondary transport line in said second interior of said housing.

16. The method of claim 15 further comprising the step of providing a brim under said housing, said brim projecting into said first interior of said container.

17. The method of claim 16 wherein said product comprises a liquid phase and a vapor phase, said method further comprising the step of removing said vapor phase by passing said vapor phase through said primary transport line, through said secondary transport line and out through said first valve.

18. The method of claim 15 wherein said product is a solid phase product, said method further comprising the steps of:

providing a second valve that is in fluid communication with said container interior;

coupling one end of a product tube to said second valve; applying a positive pressure of a gas to said second valve to agitate said solid phase product; and applying a vacuum to said first valve to pass said solid phase through said primary transport line, through said secondary transport line and out through said first valve to remove said solid phase product from said container.

19. The method of claim 15 wherein said product is a solid phase product, said method further comprising the steps of:

providing a second valve that is in fluid communication with said container interior;

coupling one end of a product tube to said second valve;

applying a positive pressure of a gas to said second valve to agitate said solid phase product; and applying a pressure differential to said first valve to pass said solid phase through said primary transport line, through said secondary transport line and out through said first valve to remove said solid phase product from said container.

20. The method of claim 15 wherein said product is a gaseous phase product, said method comprising the step of opening said first valve to pass said gaseous phase through said primary transport line, through said secondary transport line and out through said first valve to remove said gaseous phase product from said container.

21. A method for maximizing the amount of product in a container that is secured entirely within a support structure of a fixed volume. said method comprising the steps of:

providing a container whose outer surface defines a periphery and wherein said container comprises a product therein;

providing a recess in said outer surface;

positioning equipment within said recess such that said recess prevents said equipment from protruding beyond said periphery of said outer surface, said equipment providing communication to the product in said container;

providing a base for said recess;

providing a housing coupled to said base and wherein said housing has a second interior that is exposed to the product in said container;

positioning a first open end of a primary transport line in said upper portion of said first interior of said container and positioning a second open end of said primary transport line in said second interior of said housing; and coupling a third end of a secondary transport line to said first valve and positioning a fourth open end of said secondary transport line in said second interior of said housing.

22. The method of claim 21 wherein said step of providing a base comprises providing a manway that is releasably secured to an edge of an opening in said container.

23. The method of claim 22 wherein said step of providing a third end of a secondary transport line comprises coupling said secondary transport line to said manway such that when said manway is removed from said edge, said housing and said secondary transport line are also removed therewith.

24. The method of claim 23 further comprising the steps of:

providing a second valve in said recess;

coupling one end of a product tube to said second valve; and coupling said product tube to said manway such that an open end of said product tube is positioned in said container closely-adjacent a bottom portion of said container when said manway is secured to said edge and wherein said product tube is removable with said manway when said manway is removed from said edge.

25. The method of claim 24 further comprising the step of coupling a brim around said opening, said brim projecting into said first interior of said container.

26. The method of claim 25 wherein said product comprises a liquid and a vapor phase, said method further comprising the step of removing said vapor phase by passing said vapor phase through said primary transport line, through said secondary transport line and out through said first valve.

27. The method of claim 25 wherein said product is a solid phase product, said method further comprising the steps of:

applying a positive pressure of a gas to said second valve to agitate said solid phase product; and applying a vacuum to said first valve to pass said solid phase through said primary transport line, through said secondary transport line and out through said first valve to remove said solid phase product from said container.

28. The method of claim 24 wherein said product is a solid phase product, said method further comprising the steps of:

applying a positive pressure of a gas to said second valve to agitate said solid phase product; and applying a pressure differential to said first valve to pass said solid phase through said primary transport line, through said secondary transport line and out through said first valve to remove said solid phase product from said container.

29. The method of claim 24 wherein said product is a gaseous phase product, said method comprising the step of opening said first valve to pass said gaseous phase through said primary transport line, through said secondary transport line and out through said first valve to remove said gaseous phase product from said container.

* * * * *